United States Patent [19]

Kalischewski et al.

[11] Patent Number: 4,833,840

[45] Date of Patent: May 30, 1989

[54] TELESCOPING WALL ELEMENT OF A MOVABLE PARTITION

[75] Inventors: Rolf Kalischewski; Gerd Petersen; Karl Schüssler, all of Oldenburg, Fed. Rep. of Germany

[73] Assignee: Huppe GmbH, Oldenberg, Fed. Rep. of Germany

[21] Appl. No.: 59,105

[22] Filed: Jun. 8, 1987

[30] Foreign Application Priority Data

Jun. 9, 1986 [DE] Fed. Rep. of Germany ..... 3619392

[51] Int. Cl.[4] ..... E04B 2/82

[52] U.S. Cl. ..... 52/64; 52/243.1; 52/240; 160/197

[58] Field of Search ..... 52/67, 243.1, 240, 122, 52/64; 160/197

[56] References Cited

U.S. PATENT DOCUMENTS

| | | | |
|---|---|---|---|
| 3,327,439 | 6/1967 | Eatough | 52/243.1 |
| 3,341,992 | 9/1967 | Piper | 52/243.1 |
| 3,638,376 | 2/1972 | Howes et al. | 52/243.1 |
| 4,014,137 | 3/1977 | Williams | 52/126.3 |
| 4,034,524 | 7/1977 | Fromme et al. | 52/240 |
| 4,205,498 | 6/1980 | Unayama | 52/243.1 |
| 4,462,192 | 7/1984 | Fisher | 52/243.1 |
| 4,549,380 | 10/1985 | Haab | 52/243.1 |

FOREIGN PATENT DOCUMENTS

| | | | |
|---|---|---|---|
| 717 | 2/1979 | European Pat. Off. | 52/240 |
| 2836126 | 8/1978 | Fed. Rep. of Germany . | |
| 3425484 | 7/1984 | Fed. Rep. of Germany . | |
| 3239485 | 10/1987 | Fed. Rep. of Germany . | |
| 842162 | 10/1981 | U.S.S.R. | 52/67 |

*Primary Examiner*—John E. Murtagh
*Assistant Examiner*—Caroline D. Dennison
*Attorney, Agent, or Firm*—Merchant, Gould, Smith, Edell, Welter & Schmidt

[57] ABSTRACT

Presented is a two-shell telescopic element of a movable partition containing (holding) two external cover panels on the supporting frame of a wall section, between which, at the upper and/or lower edge, are guided packing strips, and that are extendable out toward the ceiling and/or the floor. An edge-side telescoping part has a vertical edge strut to which are also attached cover panels that overlap the cover panels of the wall section, or that continue in surface-flush fashion. The packing strips have an edge section projecting inwardly between the cover panels of the telescoping part, said edge section being horizontally displaceable together with the telescoping part. In order to achieve an improved noise damping, provided are intermediate panels that engage behind the cover panels of the wall section and of the telescoping part.

11 Claims, 11 Drawing Sheets

TELESCOPING WALL ELEMENT OF A MOVABLE PARTITION

TECHNICAL FIELD

The invention concerns a two-shell telescopic element of a movable partition, with one wall section that contains cover panels on both sides of a supporting frame and that is displaceably suspended with running rollers in ceiling-fast running rails, with a telescoping part that is extendable horizontally from the wall section, with externally lying cover panels, with packing (sealing) strips at the upper and/or lower edge of the wall section that are extendable between the cover panels against the ceiling and/or the floor and with a packing strip edge section that extends in between the cover panels of the telescoping part and that is coupled with the telescoping part.

BACKGROUND OF THE INVENTION

Movable, smooth partitions consist of several individual wall elements that are suspended in displaceable fashion by means of running rollers in running rails firmly attached to the ceiling. For opening and/or removal of the partition, the individual wall elements are released from a locking means and displaced along the running rail, and stacked in a stacking area. For closing the partition, the wall elements are brought into a plane, arranged tightly against one another and braced by packing strips that are extended out against the ceiling and/or the floor, between the covering panels of the wall elements. Further provided on one or the other lateral end of the partition is a telescopic element having an edge-side telescoping part which, when closing the wall, is capable of being extended out horizontally against a solid building wall or the like, in order also to brace the wall elements horizontally against one another and to close the available open gap of the building opening in question crack-free with the partition.

The known telescopic elements have on their telescoping part external cover panels that overlap the cover panels of the wall section in the retracted as well as in the extended position, in order to effect an optically clean partition closure. Since the cover panels of the telescoping part overlap the cover panels of the wall section, the telescoping part cover panels of the packing strip edge section that is coupled with the telescoping part is spaced by the amount of the thickness of the wall section cover panels. If the telescoping part is extended, there then arises between the cover panels of the telescoping part an intermediate space which, in the retracted position of the telescoping part, is filled in by the cover panels of the wall section. The intermediate space formed when extending the telescoping part has as a consequence reducing the acoustical damping of the partition at this location, because sound waves can then pass through under the packing strip end section from this intermediate space, from one to the other side of the telescopic element.

The object for the invention, as compared to this, is to develop further a two-shell telescopic element of the initially mentioned art such that there is obtained an improved damping of noise, with an optically appealing appearance.

SUMMARY OF THE INVENTION

This task is resolved in accordance with the invention by the fact that there are provided relatively thin intermediate panels that engage behind the cover panels of the wall section and the cover panels of the telescoping part in their impacting or overlapping region.

The advantages of the invention lie particularly in the fact that the joints arising between the cover panels of the wall section and the cover panels of the telescoping part when extending the telescoping part are masked by internally located intermediate panels over essentially the entire vertical height of the telescopic element. Since the intermediate panels, compared to the cover panels, have a considerably reduced wall thickness and, besides this, consist of an extensively, acoustically damping material, now generated when extending the telescoping part between its cover panels and the likewise telescoping packing strip edge section is only a comparatively narrow intermediate space that corresponds to the wall thickness of the cover panels. These narrow gaps are masked by outwardly spreading rubber lips that are located on the packing strips so that unobstructed passage of sound waves is prevented.

According to a particularly preferred form of embodiment of the invention, the cover panels of the wall section and the cover panels of the telescoping part align upon impacting (touching) and the intermediate panels are attached to the inner surfaces of the cover panels of the wall section of the telescoping part and engage with their free ends behind the cover panels of the telescoping part and/or of the wall section, and in this fashion form the basis of the shadow joints arising when extending the telescoping part, which is equal to or greater than the telescoping travel stroke. This form of embodiment has the advantage that the cover panels of the telescoping part also align with the other cover panels of the partition so that there arises an aesthetically appealing, smooth configuration of the entire partition.

Alternatively, it is also possible that the cover panels of the telescoping part overlap the cover panels of the wall section in both the retracted and the extended condition. With this form of embodiment, the intermediate panels are attached to the free vertical edge of the telescoping part and project with their free ends behind the cover panels of the wall section. When extending the telescoping part, there then arises a free (open) spade between the cover panels of the telescoping part and the intermediate panels; passage of noise, however, is effectively suppressed by the intermediate panels that lie up against the packing strips and packing strip edge sections.

According to another particularly preferred form of embodiment of the invention, the cover panels of the telescoping part are guided by means of a suitable mechanism (in accordance with the simultaneously submitted patent application, Ser. No. 07/059,044. . . ) such that they overlap the cover panels of the wall section during the telescoping movement and, upon reaching the extended position, come loose from the covering panels of the wall section and then transfer—perpendicularly to the plane of the panels—into a position aligning in surface-flush fashion with the cover panels of the wall section. In this form of embodiment of the invention, the intermediate panels are installed in enclosed fashion against the cover panels of the wall section and project with their ends sufficiently far enough into the telescoping part to form the basis for the desired or resulting shadow joint.

According to one form of embodiment of the invention, the packing strips of the wall section align with the packing strip edge sections of the telescoping part upon impacting (touching). According to the invention, then provided in the region of this place of impacting are additional masking elements on the packing strips whose vertical height is about equal to the height of the packing strips, so that a direct path for passage of the sound waves is also prevented at these places of impact when extending the telescoping part. Alternatively, it is possible that the packing strip edge sections overlap the packing strips in telescoping fashion, whereby likewise prevented is an open path for passage of noise. The impacting or overlapping regions between packing strips and packing strip edge sections can be offset against the impacting or overlapping regions of the cover panels. The masking elements between the packing strips and packing strip edge sections aligning upon impact can then be advantageously placed in externally lying fashion either on the packing strip or on the packing strip edge section, and then lie in a plane aligning with the intermediate panels.

Preferentially, disposed between the packing strips, the packing strip edge sections and the cover panels are elastic (flexible) sealing lips.

Explained in more detail in the following with the aid of the drawings are examples of embodiments of the invention.

DETAILED DESCRIPTION OF THE INVENTION

Figure 1:
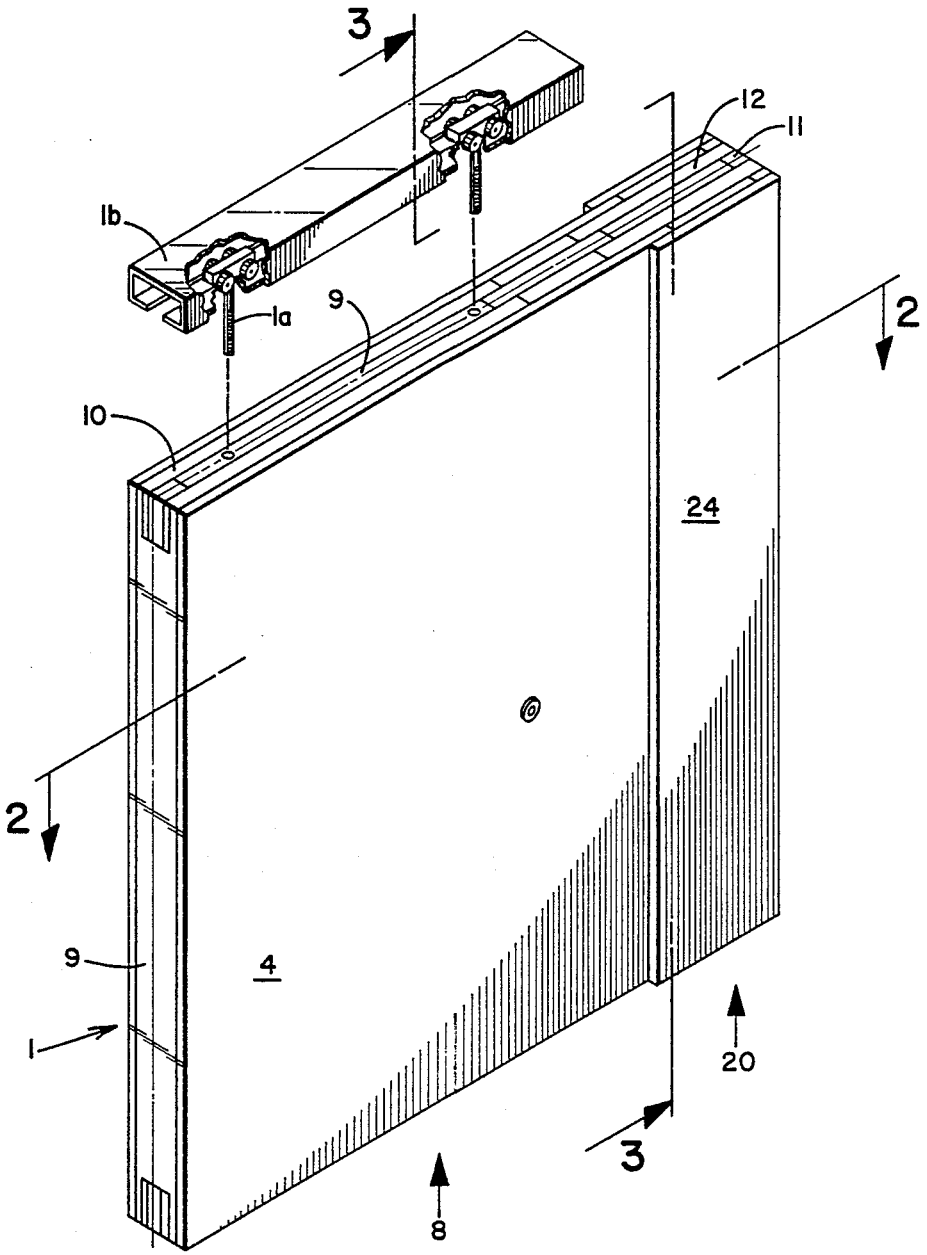
FIG. 1 is an isometric view of a known telescopic element.

FIG. 1 shows an isometric view of the two-shell telescopic element 1 that is suspended in longitudinally displaceable fashion on running rollers 1*a* in a heavy rail 1*b*. The telescopic element 1 has a wall section 8 to whose supporting frame 9 are attached the running rollers 1*a* and cover panels 4 lying externally on both sides. Provided at one vertical edge of the wall section 8 is a telescoping part 20 that extends over the entire height of the wall section 8 and that is extendable out therefrom horizontally over a predetermined stroke of travel. The telescoping part 20 has cover panels 24 that partially overlap the cover panels 4 of the wall section 8 during the telescoping movement and that run in corresponding, externally lying, parallel running planes when the telescoping part 20 moves horizontally. The cover panels 4 of the wall section 8 and the cover panels 24 of the telescoping part 20 include an one each upper and a lower horizontal packing strip 10 that have a packing strip edge section 12 coupled with the telescoping part 20. Disposed between the cover panels 4 of the wall section 8 and the cover panels 24 of the telescoping part 20 is an actuating mechanism (not illustrated) that displaces both the telescoping part 20 and the packing strips 10 by means of an externally (e.g. at the point 5) attachable crank. (The actuating mechanism is represented in the copending application, Ser. No. 07/059,044 filed simultaneously herewith in the name of inventor Karl Schussler, in particular in FIG. 5 and in the associated description, and should be a component part of the present application by means of this reference).

Figure 2:
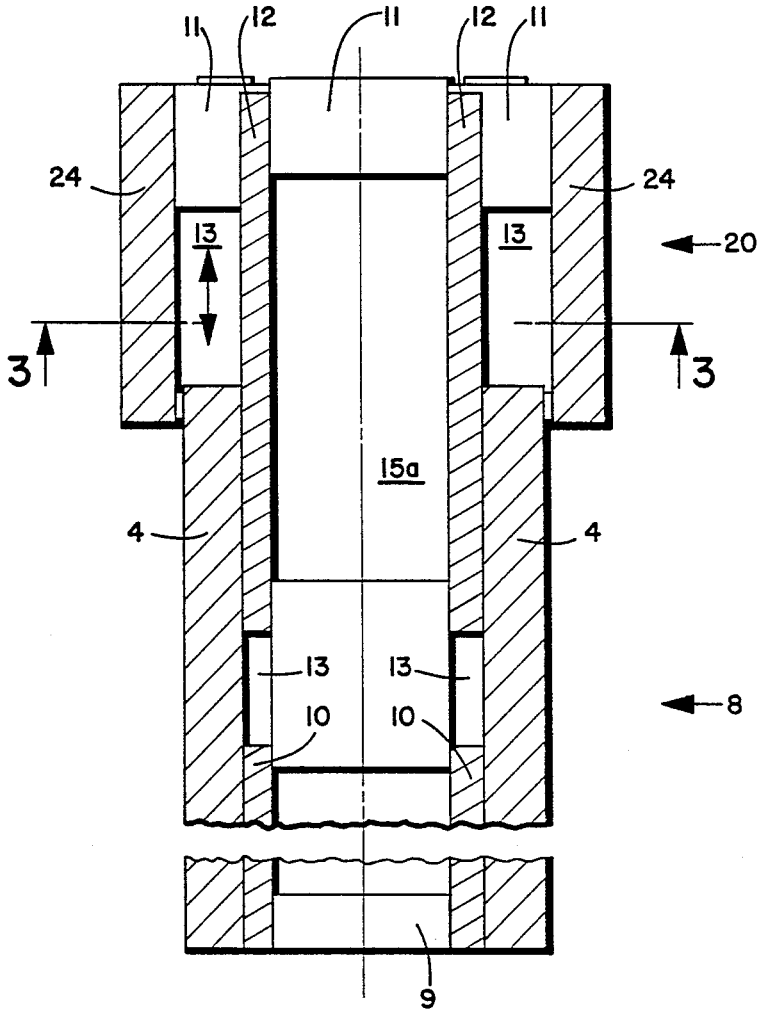
FIG. 2 is a horizontal cut along the line II—II of FIG. 1.
Figure 3:
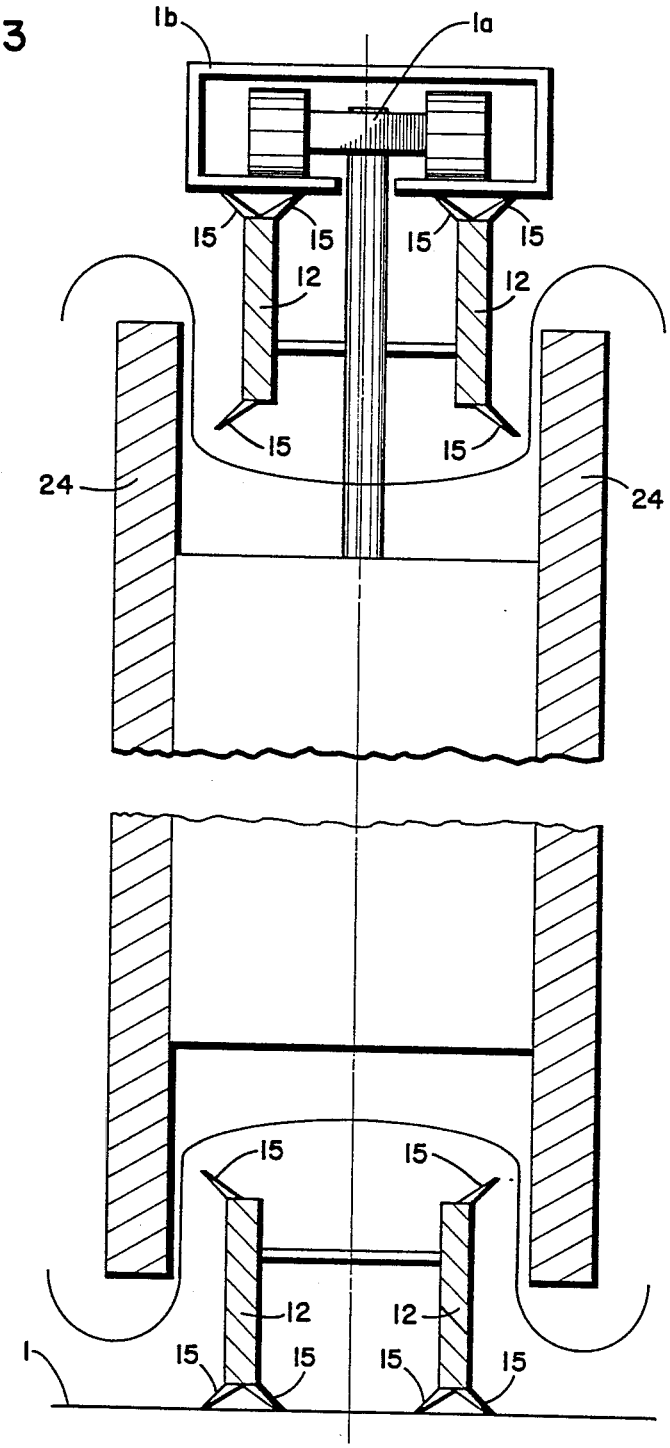
FIG. 3 is a vertical cut along the line III—III of FIG. 1 or 2.

FIG. 2 shows a horizontal cut along the line II—II of FIG. 1, and FIG. 3 shows a vertical cut along the line III—III of FIG. 1 or 2. As can be obtained from FIGS. 2 and 3, arising when extending the telescoping part 20, in the case of this known telescoping element 1, between the cover panels 24 and the packing strip edge section 12, on both sides, is an impact (contacting, touching) joint 13 through which sound waves can pass undisturbed. Besides this, arising at the impacting location, between the packing strips 10 and the packing strip edge section 12, is another impacting joint 13 that likewise allows undisturbed passage of sound waves.

Figure 4:
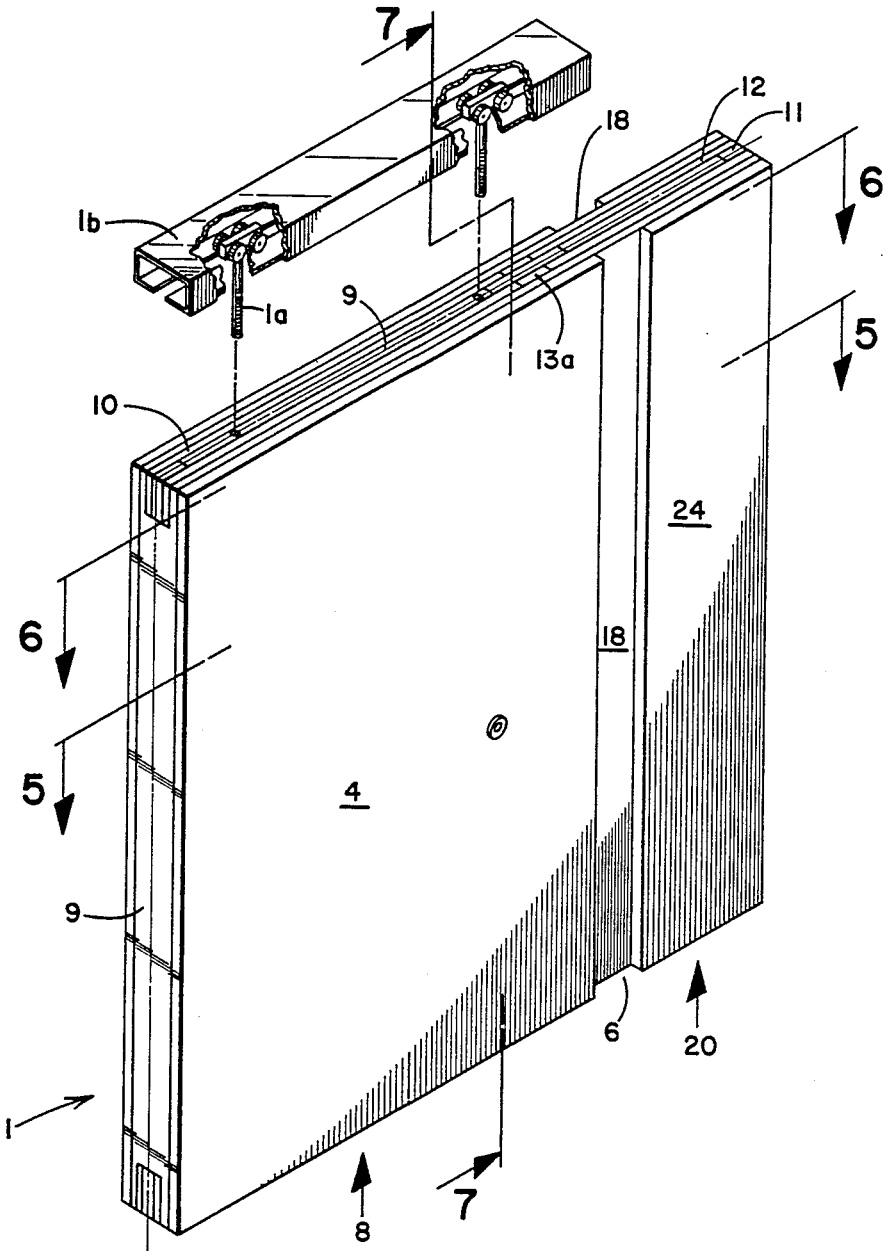
FIG. 4 is an isometric view of a first form of embodiment of the telescopic element in accordance with the invention.
Figure 5:
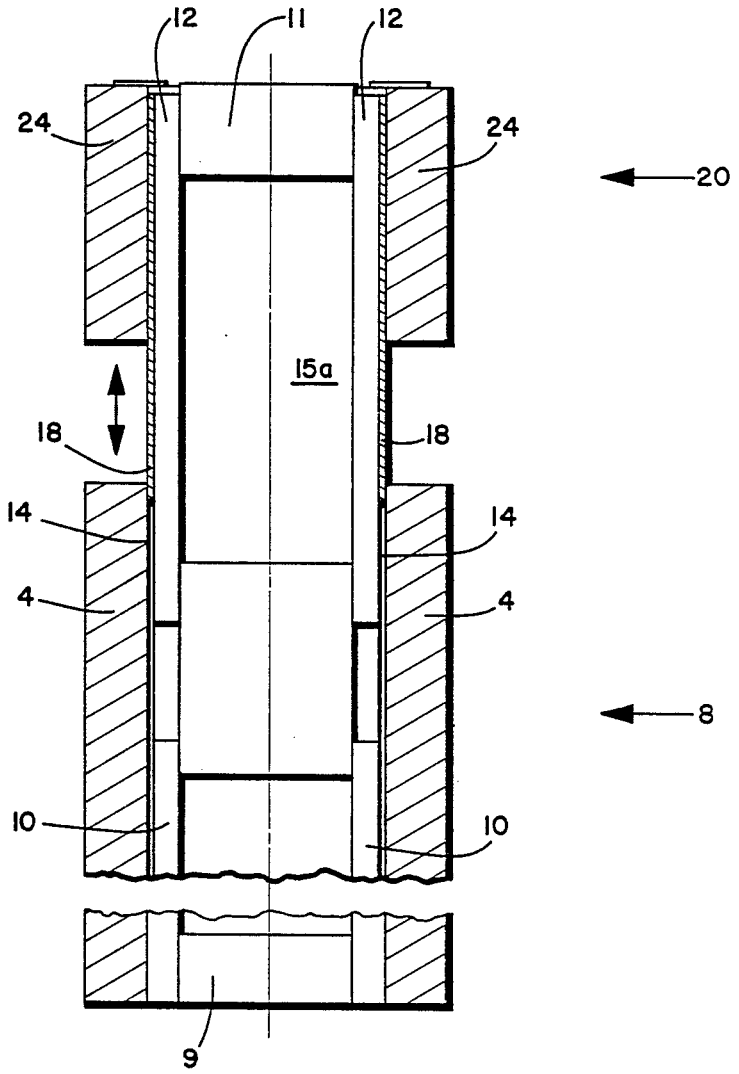
FIG. 5 is a horizontal cut along the line V—V of FIG. 4.
Figure 6:
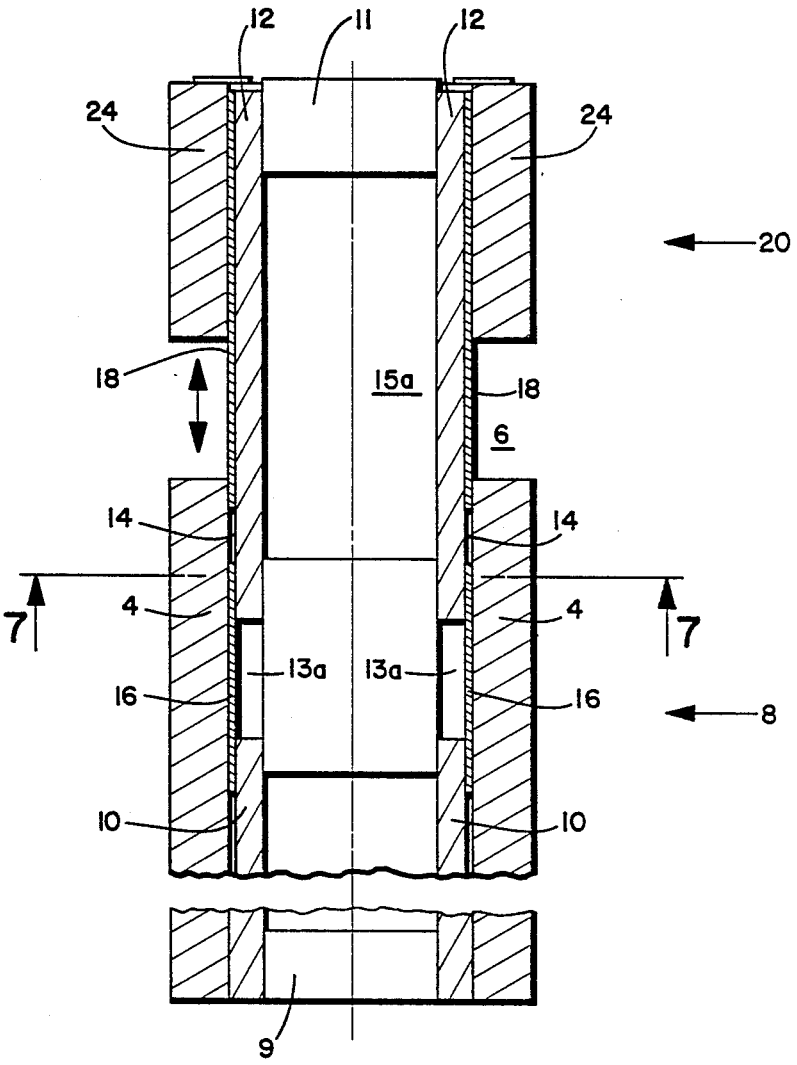
FIG. 6 is a horizontal cut along the line VI—VI of FIG. 4.
Figure 7:
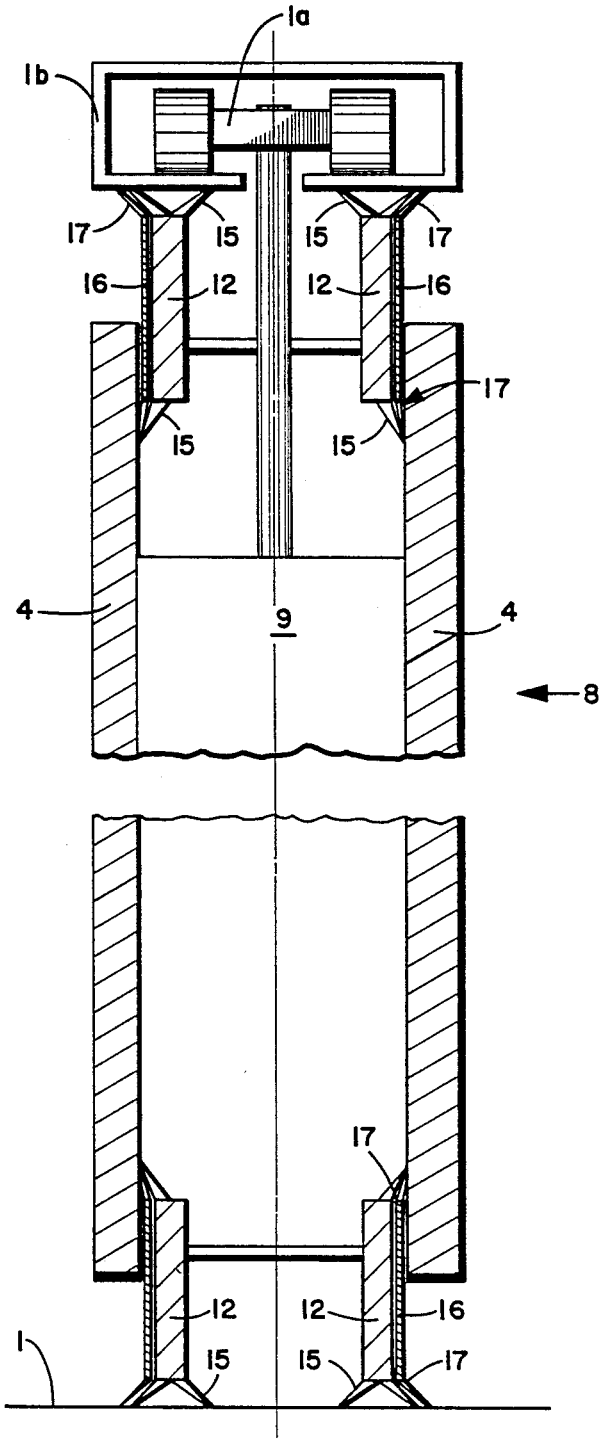
FIG. 7 is a vertical cut along the line VII—VII of FIG. 4, respectively 6.
Figure 8:
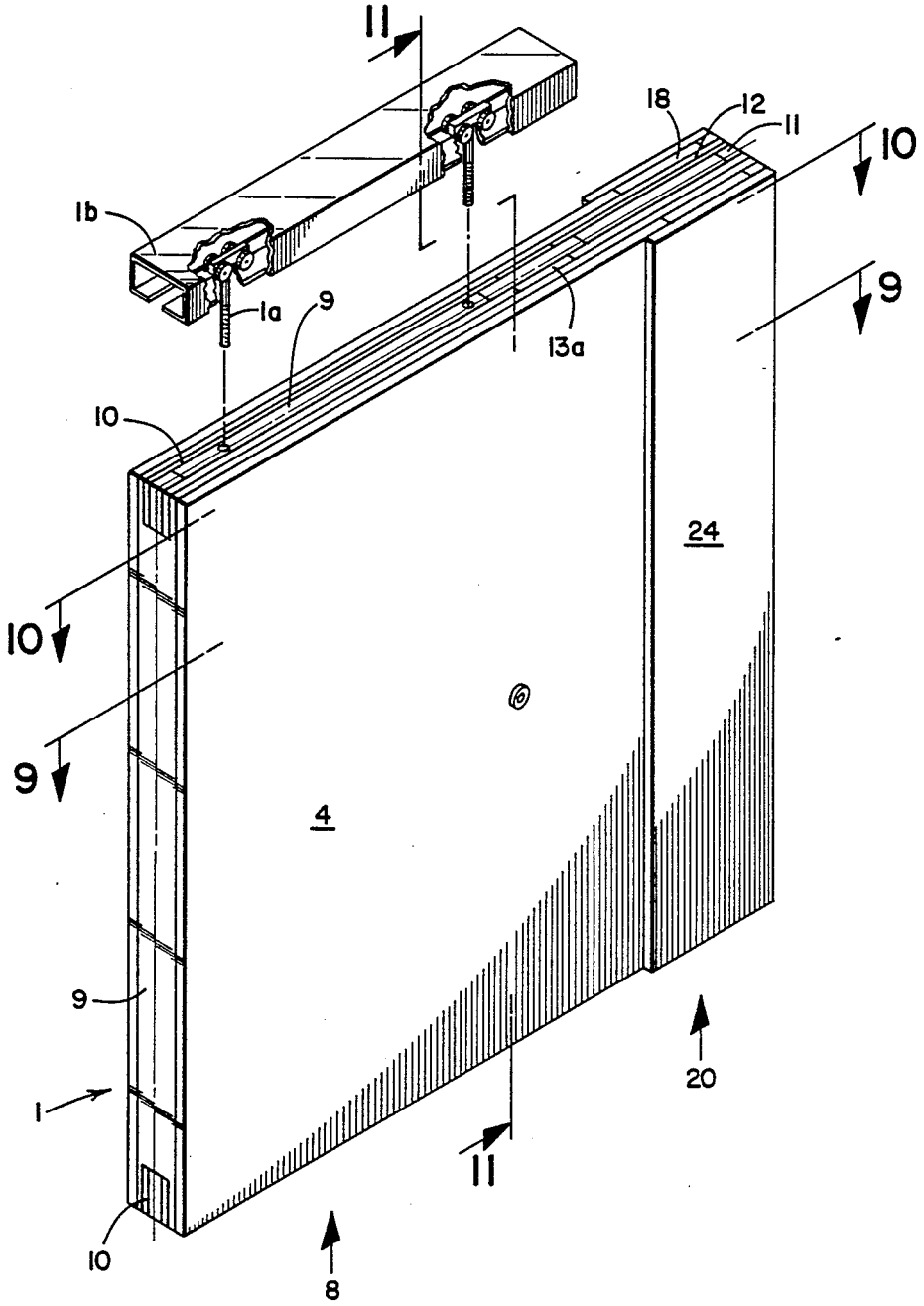
FIG. 8 is an isometric view of a second form of embodiment of the telescopic element in accordance with the invention.
Figure 9:
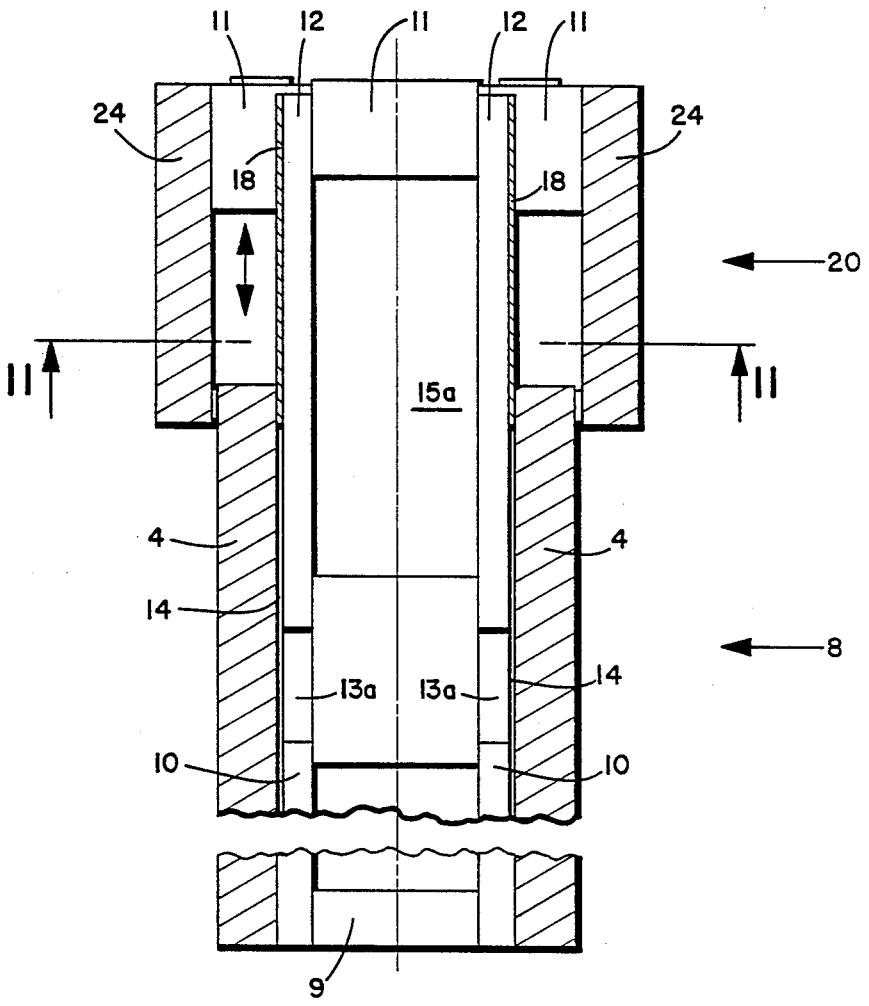
FIG. 9 is a horizontal cut along the line IX—IX of FIG. 8.
Figure 10:
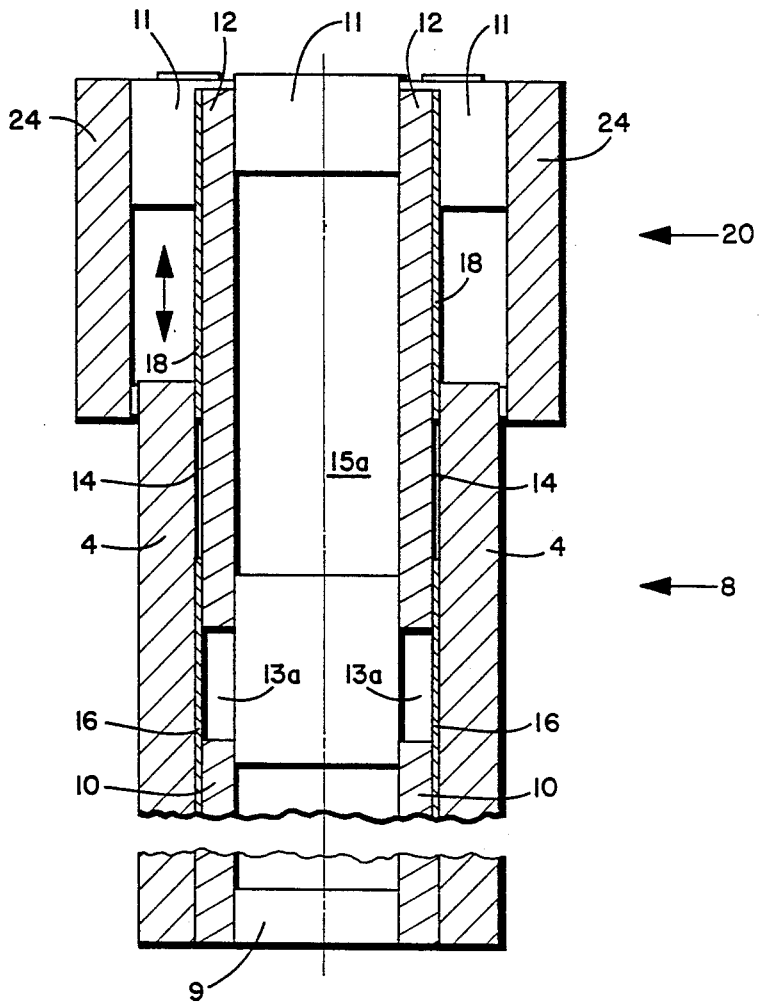
FIG. 10 is a horizontal cut along the line X—X of FIG. 8.
Figure 11:
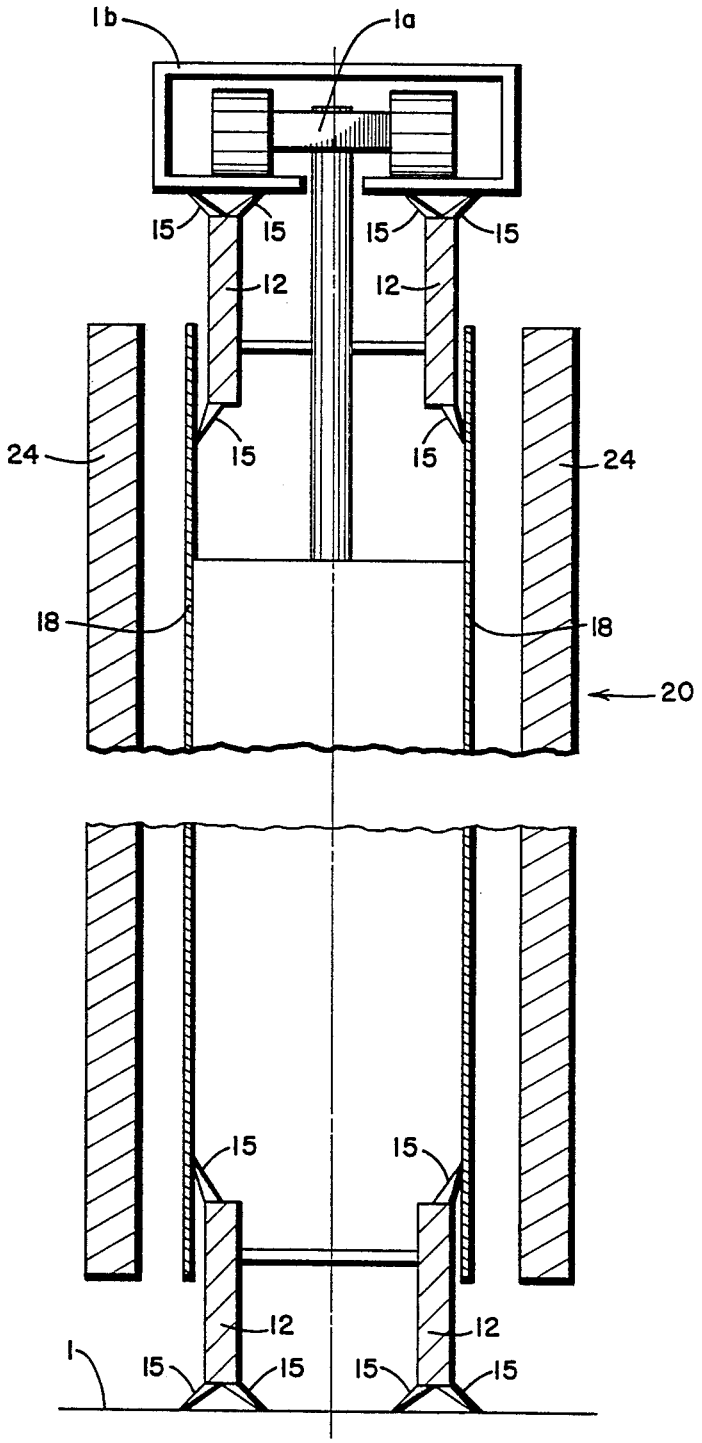
FIG. 11 a vertical cut along the line XI—XI of FIG. 8.

FIGS. 4–7 show different view of a telescopic element 1 in accordance with the invention, and actually in an isometric overall view (FIG. 4), in a first horizontal cut along the line V—V (FIG. 5), a second horizontal cut along the line VI—VI (FIG. 6) and a vertical cut along the line VII—VII (FIG. 7). FIGS. 4, 5 and 7 correspond to FIGS. 1, 2 and 3, so that the differences from the known telescopic element 1 are clearly recognizable. Screwed onto a supporting frame 9 of the wall section 8, on both sides, is one each cover panel 4. Disposed between the cover panels 4, at the upper and lower edge of the wall section 8, is one each packing strip 10 that is extendable against the floor or the ceiling, electrically or mechanically, by means of an actuating mechanism. Disposed at the right hand edge of the telescopic element 1 is a telescoping part 20 having a vertical edge strut 11 that, is horizontally extendable and is attached to each cover panel 24. The packing strips 10 have a packing strip edge section 12 projecting in between the cover panels 24 of the telescoping part 20, said edge section being coupled with the telescoping part 20 and capable of telescoping together with this latter.

In the embodiment according to FIGS. 4–7, the cover panels 4 of the wall section 8 align in surface-flush fashion with the cover panels 24 of the telescoping part 20. Screwed on against the inner surface of the cover panels 24 are thin intermediate panels 18 whose free end projects (extends) behind the cover panels 4 of the wall section 8 far enough so that the cover panels 4 are also engaged from behind even in the case of completely extended telescoping part 20. The vertical edges of the cover panels 4, 24 adjoining one another form a blunt impact point with a retracted telescoping part 20. With an extended telescoping part 20, forming at the points of impact of cover panels 4, 24 are shadow joints having the width of the telescoping travel stroke, that permit the intermediate panels 18 to make an appearance.

The intermediate panels 18 run over the entire height of the cover panels 4, 24 and consist of a thin material, e.g. sheet metal this assures that the crack 14 behind the cover panels 4, which must be available for accepting the intermediate panels 18, is very narrow.

The packing strips 10 and the packing strip edge sections 12 have sealing lips 15 lying outwardly against the cover panels 4, 24, so that no open sound path is formed from one side of the telescoping element 1 to the other side.

The upper and the lower telescopable packing strip edge section 12 are each displaceably journalled on a rail 15*a* that is firmly joined with the associated packing strip 10. The packing strip edge section 12 is coupled, e.g. at its forward end, with the edge strut 11 of the telescoping part 20. Available between the packing strip 10 and the telescopable packing strip edge section 12 is an impacting point 13*a* that is offset relative to the impacting point 6 of the cover panels 4, 24, and is masked with additional masking elements 16, compare FIG. 6 or 7. The masking elements 16 are, for example, screwed on to the external surface of the packing strip edge section 12 and overlap the packing strips 10. The wall thickness of the masking elements 16 corresponds to the wall thickness of the intermediate panels 18, so that the masking elements 16 can be brought down into the slot 14 generated by the intermediate panels 18. The masking elements 16 have approximately the height of the packing strip 10 and each displays at its upper and lower horizontal edge its own sealing lip 17, in order to realize in the region of the impacting point 13 also a mechanical obstacle against direct passage of noise.

FIGS. 8–11 show a second telescoping element in accordance with the invention whose construction corresponds to a great extent to the telescopic element represented in FIGS. 4–7, wherein like parts are given the same reference numbers. Deviating from the telescopic element of FIGS. 4–9, in the case of this second form of embodiment the cover panels 24 of the telescoping part 20 are disposed such that they overlap the cover panels 4 of the wall section 8, at least during one section (sector) of the telescoping movement. Attached at the free vertical edge of the telescoping part 20, and actually either at the edge strut or at the packing strip edge section 12, are two intermediate panels 18 that engage with their free ends toward the cover panels 4 of the wall section 8 and extend over the entire height of the cover panels 4, 24, compare FIGS. 9–11. The packing strips 10 and the packing strip edge sections 12 in turn have sealing lips 15 that lie up against the intermediate panels 13 and prevent an unhindered passage of noise from one side of the telescopic element to the other side of the telescopic element. Since the point of contact 13*a* between packing strip 10 and packing strip edge section 12 lies in the region of wall section 8, also provided in the case of this form of embodiment are additional masking elements 16 which, having the height of the packing strips 10, are screwed onto the packing strips 10 or to the packing strip edge sections 12, and overlap the impacting points 13*a* that form when telescoping. In this fashion, impacting point 13*a* is also blocked against direct passage of noise.

The intermediate panels 18 and the masking elements 16, in comparison to cover panels 4, 24, have a small wall thickness.

What is claimed is:

1. A telescoping wall element of a movable partition, comprising:

(a) one wall section including cover panels on both sides of a supporting frame, said wall section displaceably suspended with running rollers and ceiling fast running rails; and (b) a telescoping part extendable horizontally from said wall section, including externally lying cover panels; and (c) at least one packing strip along an edge of said wall section, said packing strip vertically extendable between a first retracted position and a second extended position; and (d) a packing strip edge section that extends between said telescoping part cover panels, said packing strip edge section couple with said telescoping part; and (e) intermediate panels fixed behind said wall section cover panels and said telescoping part cover panels at an impacting region of said wall section cover panels and said telescoping part cover panels.

2. A telescoping wall element according to claim 1, wherein said wall section cover panels and said telescoping part cover panels align in surface-flush fashion, and said intermediate panels having fixed ends and opposite free ends, said fixed ends attached to wall section cover panels, and said free end extending behind telescoping part cover panels.

3. A telescoping wall element according to claim 1, wherein said wall section cover panels and said telescoping part cover panels align in surface-flush fashion, and said intermediate panels having fixed ends and opposite free ends, said fixed ends attached to telescoping part cover panels, and said free end extending behind wall section cover panels.

4. A telescoping wall element according to claim 1, wherein said telescoping part cover panels overlap said wall section cover panels, and said intermediate panels are fixed to a free vertical edge of said telescoping part, and intermediate panels including free ends which engage behind said cover panels of said wall section in enclosed fashion.

5. A telescoping wall element according to claim 1, wherein said telescoping part cover panels overlap said wall section cover panels in said retracted position, and in said second extended position align in surface-flush fashion with said wall section cover panels, said intermediate panels including fixed ends adjacent to and fixed to said wall section, and opposite free ends which engage said cover panels of said telescoping part.

6. A telescoping wall element according to claim 1, wherein said intermediate panels are thin sheets having a height equal to telescoping part cover panel height.

7. A telescoping wall element according to claim 1, wherein said packing strips and said packing strip edge sections align upon impact and in a region of their impacting are overlapped by masking elements.

8. A telescoping wall element according to claim 1, wherein said packing strip edge section overlap said packing strips in telescoping fashion.

9. A telescoping wall element according to claim 7, wherein said impacting region between said packing strip and said packing strip edge section is offset against said impacting region of said wall section cover panels and said telescoping part cover panels.

10. A telescoping wall element according to claim 1, wherein elastic ceiling lips are disposed between said packing strips, said packing strip edge sections and said cover panels.

11. A telescoping wall element according to claim 7, wherein said masking elements include elastic ceiling lips directed toward said cover panels.

* * * * *